US005810681A

United States Patent [19]

Heim

[11] Patent Number: 5,810,681

[45] Date of Patent: Sep. 22, 1998

[54] APPARATUS FOR PICKING UP AND DISPENSING BALLS

[76] Inventor: John Heim, 763 Slater Ave., Pleasant Hill, Calif. 94523

[21] Appl. No.: 877,376

[22] Filed: Jun. 17, 1997

[51] Int. Cl.[6] ..... A63B 47/02

[52] U.S. Cl. ..... 473/496; 294/19.2; 221/199; 221/303

[58] Field of Search ..... 294/19.2; 24/442; 206/315.9; 221/185, 199, 281–283, 303, 307, 309, 310; 224/919; 248/205.2; 473/21, 286, 496

[56] References Cited

U.S. PATENT DOCUMENTS

| | | | |
|---|---|---|---|
| D. 83,254 | 2/1931 | Holm | 294/19.2 X |
| 713,672 | 11/1902 | Oliver . | |
| 2,027,546 | 1/1936 | MacDonald . | |
| 2,760,807 | 8/1956 | Watson . | |
| 3,206,067 | 9/1965 | Smith et al. | 294/19.2 X |
| 4,045,068 | 8/1977 | Nelson . | |
| 4,046,284 | 9/1977 | Samuelsson | 294/19.2 X |
| 4,058,336 | 11/1977 | Parkinson . | |
| 4,629,235 | 12/1986 | Loque . | |
| 5,292,161 | 3/1994 | Green | 294/19.2 |
| 5,395,146 | 3/1995 | Liu et al. . | |
| 5,651,742 | 7/1997 | Dickson | 294/19.2 X |

FOREIGN PATENT DOCUMENTS

| | | | |
|---|---|---|---|
| 1429211 | 1/1966 | France | 294/19.2 |
| 2454820 | 12/1980 | France | 294/19.2 |
| 2529467 | 1/1984 | France | 294/19.2 |
| 3136170 | 3/1983 | Germany | 294/19.2 |

*Primary Examiner*—Johnny D. Cherry
*Attorney, Agent, or Firm*—Thomas R. Lampe

[57] ABSTRACT

Apparatus for retrieving balls and for serially dispensing the balls including a double-ended, elongated tubular member for housing a plurality of balls. A ball capture member is provided at one of the ends of the tubular member and a ball receiving member is connected to the other end of the tubular member. The tubular member, ball capture member and ball receiving member are releasably connected to a support surface such as the side wall of a ping pong table.

4 Claims, 4 Drawing Sheets

APPARATUS FOR PICKING UP AND DISPENSING BALLS

TECHNICAL FIELD

This invention relates to apparatus for picking up and dispensing balls. The invention is particularly applicable to ping pong or table tennis balls. Elements of the apparatus are selectively positioned on a table tennis or ping pong table to dispense ping pong balls or removed from the table to retrieve ping pong balls from the floor or other locations.

BACKGROUND OF THE INVENTION

Persons playing ping pong are often faced with having to retrieve ping pong balls that have gone astray during play. Pick up of the ping pong balls is not only time consuming but a laborious task as well. Yet another problem presents itself with respect to ping pong balls. Players may go through many balls during the course of a game and typically there is no convenient supply or reserve of replacement balls. Players may be forced to walk to a location spaced from the ping pong table to obtain a new ball in order to continue the game.

The apparatus of the present invention provides for a ready and convenient supply of ping pong balls without the necessity of players having to leave the immediate vicinity of the ping pong table.

The following United States patents disclose various types of devices employed to retrieve different types of balls: U.S. Pat. No. 5,395,146, issued Mar. 7, 1995; U.S. Pat. No. 4,629,235, issued Dec. 16, 1986; U.S. Pat. No. 4,058,336, issued Nov. 15, 1977; U.S. Pat. No. 4,045,068, issued Aug. 30, 1977; U.S. Pat. No. 713,672, issued Nov. 18, 1902; U.S. Pat. No. 2,027,546, issued Jan. 14, 1936; and U.S. Pat. No. 2,760,807, issued Aug. 28, 1956. The structure shown in these patents is believed representative of the current state of the prior art pertaining to ball retrieval.

Typically, ball retriever structures of the prior art employ side openings for dispensing retrieved balls from a tube-like container, the openings being located at the ball retrieval ends of the devices and requiring special closure structure which must be operated in some manner to dispense the balls. Such devices do not readily lend themselves to use in conjunction with a ping pong table during the dispensing operation and are generally characterized by their relative complexity and high expense.

DISCLOSURE OF INVENTION

The present invention, on the other hand, is characterized by its relative simplicity and low cost. Furthermore, certain operative structural components of the apparatus are conveniently releasably mounted on a ping pong table to dispense balls to the players at such location. Alternatively, the structure may be readily removed from the table and employed to retrieve ping pong balls from the floor or other locations.

The apparatus of the present invention is for retrieving balls and for serially dispensing the balls. The apparatus includes a double-ended, elongated tubular member defining an interior, a ball inlet at one end of the double-ended, elongated tubular member and a ball outlet at the other end of the double-ended, elongated tubular member. The ball inlet and the ball outlet communicate with the interior.

Ball capture means is connected to the double-ended, elongated tubular member at the ball inlet for allowing the serial ingress of balls through the ball inlet into the interior and for resisting egress of balls from the interior through the ball inlet.

Ball receiving means is connected to the double-ended, elongated tubular member at the ball outlet for serially receiving balls from the interior. The ball receiving means is for accommodating end-most ball of a plurality of balls in the interior. The ball receiving means defines an opening allowing manual access to and retrieval of the end-most ball and includes a ball stop for retaining the end-most ball in registry with the opening.

Mounting means is provided for mounting the double-ended, elongated tubular member with the ball inlet thereof elevated relative to the ball outlet thereof for promoting gravity feed of balls within the interior to the ball receiving means.

In the preferred embodiment of the invention, the balls are ping pong balls and the apparatus additionally comprises a ping pong table having a ping pong table side wall. The mounting means comprises releasable mounting means for releasably mounting the double-ended, elongated tubular member on the side wall.

Other features, advantages, and objects of the present invention will become apparent with reference to the following description and accompanying drawings.

BEST MODE FOR CARRYING OUT THE INVENTION

Figure 1:
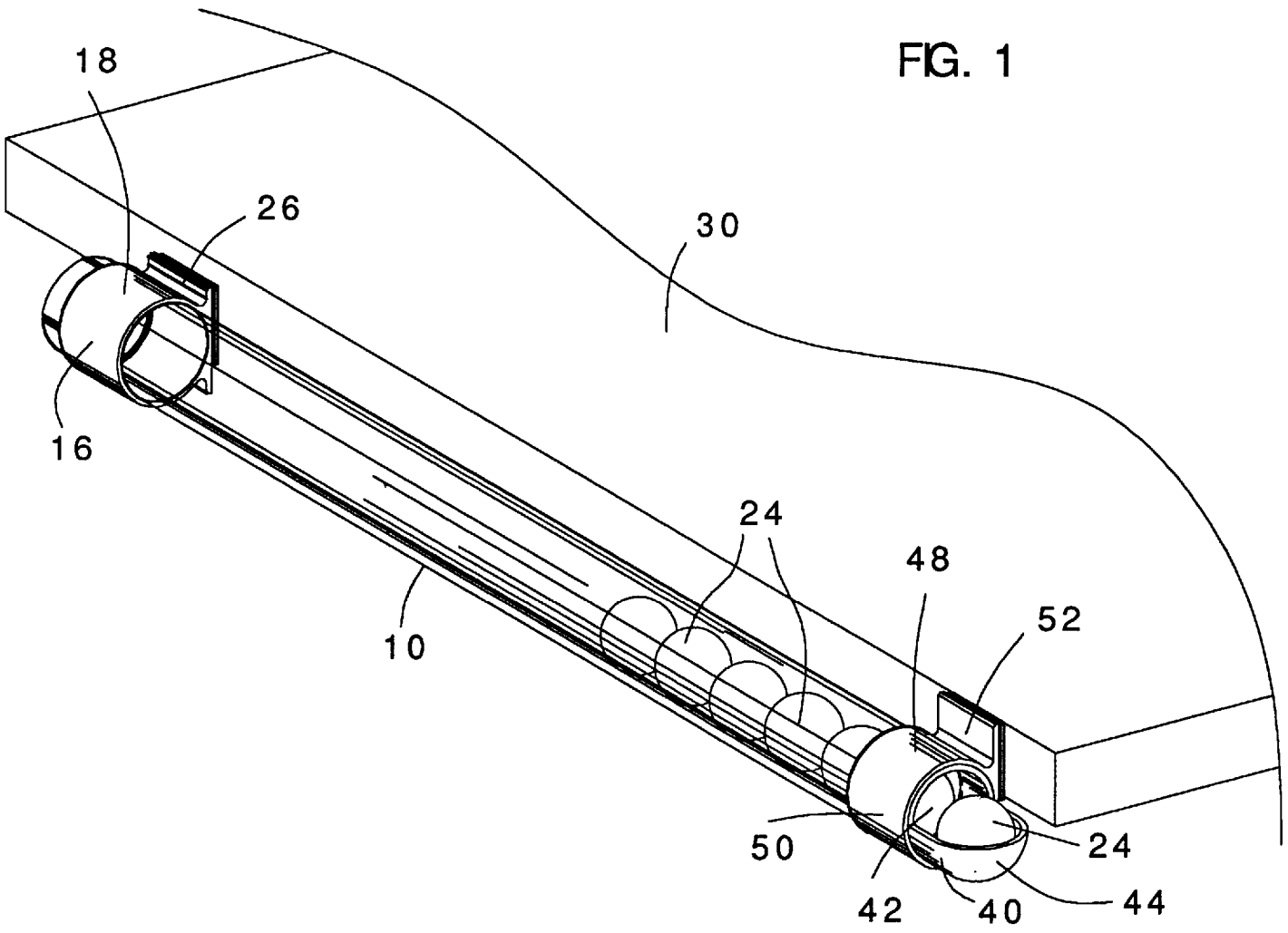
FIG. 1 is a perspective view of apparatus constructed in accordance with the teachings of the present invention and including a ping pong table, only a portion of the latter being illustrated.

Referring to the drawings, apparatus constructed in accordance with the teachings of the present invention includes a double-ended, elongated tubular member 10 defining an interior. The tubular member 10 has a ball inlet 12 at one end thereof and a ball outlet 14 at the other end thereof. The ball inlet and the ball outlet communicate with the interior of the tubular member. The tubular member may suitably be, and is illustrated as being, transparent, plastic being a suitable material for construction of the tubular member.

Attached to the ball inlet end of the tubular member is a ball capture member 16, suitably integrally formed from molded plastic. Ball capture member 16 includes an open-ended conduit portion 18. Conduit 18 includes flexible, spaced conduit wall elements 20 having distal ends. Projections 22 are attached to the flexible, spaced conduit wall elements and project inwardly to define a restricted opening leading to the conduit interior. The opening is smaller than a ping pong ball.

Figure 4:
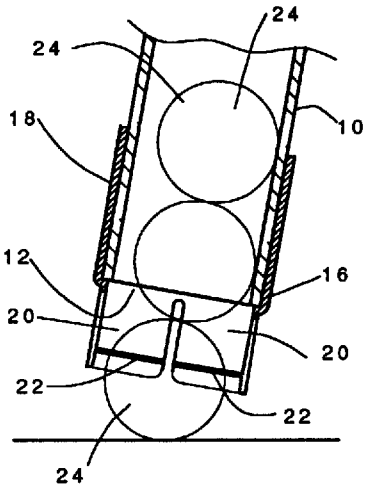
FIG. 4 illustrates the ball retriever end of the apparatus in engagement with a ping pong ball during capture of the ball.

FIG. 4 illustrates the ball capture member 16 placed into engagement with a ping pong ball 24 on a floor or other support surface. It will be appreciated that downward movement of the ball capture member and related tubular member 10 will cause the projections 22 engaged by the ball and the related conduit wall elements 20 to flex apart sufficiently to allow the ping pong ball 24 to enter through the opening and join other balls illustrated in FIG. 4 already disposed within the tubular member interior. Egress of the balls from the interior back through the ball inlet will be prevented due to the projections 22 and associated conduit wall elements 20 moving back to their unstressed positions after a ping pong ball has been captured.

Figure 7:
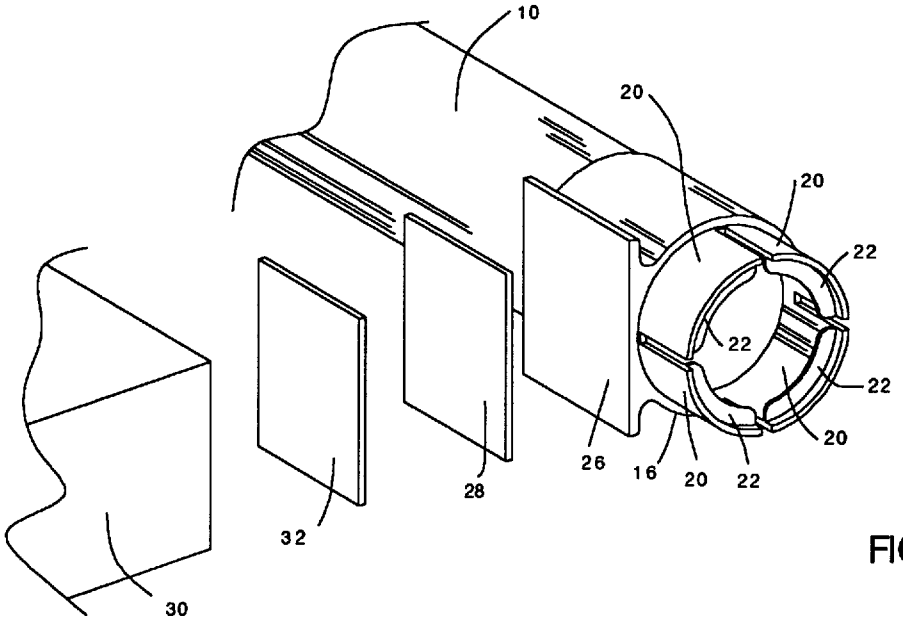
FIG. 7 is an exploded, perspective, enlarged view of the ball capture means of the apparatus and related structure.

Ball capture member 16 also includes a plate 26 having an outer planar surface. Adhesively secured to the outer surface of plate 26 is a strip 28 (See FIG. 7) of synthetic fabric fastener material, such as the material sold under the trademark Velcro.

The ball capture member 16 is for releasable attachment to one of the four sides of a ping pong table 30, a portion of such table being shown in certain of the drawing figures. To accomplish this, a second strip 32 of synthetic fastener material is secured to a side wall of the ping pong table.

A ball receiving member 40 is connected to the tubular member at the ball outlet thereof for serially receiving balls from the interior.

Ball receiving member 40 is for accommodating an end-most ball of a plurality of balls in the interior and has a generally cup-like configuration, preferably being formed of molded plastic material. Ball receiving member 40 defines an opening 42 allowing manual access to and retrieval of the end-most ball. Member 40 includes a ball stop 44 for retaining the end-most ball 24 in registry with opening 42.

A coupler member 48, also suitably formed of molded plastic, interconnects the ball receiving member 40 to the ball outlet end of tubular member 10. In the illustrated preferred embodiment of the invention, the coupler member is in frictional engagement with the double-ended, elongated tubular member and with the ball receiving member so that the coupler member 48 may be reversed relative to the ball receiving member and relative to the tubular member.

Figure 2:
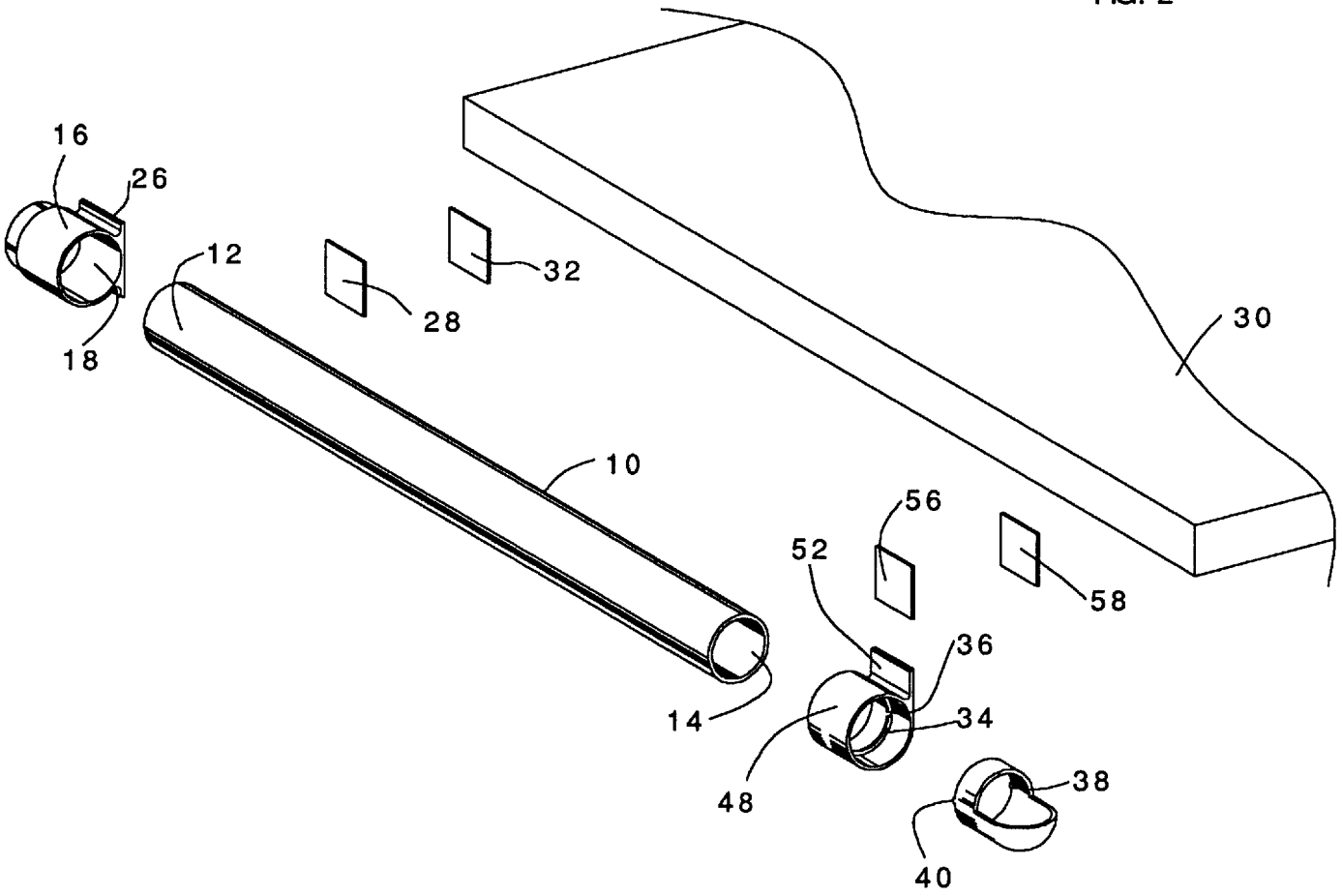
FIG. 2 is an exploded view illustrating structural components of the apparatus prior to assembly thereof.

The coupler member 48 includes an open-ended conduit portion 50 and a projecting plate-like element 52 projecting laterally from the open-ended conduit and having or forming a substantially planar mounting surface 54. One strip 56 of synthetic fabric fastener material is secured to the planar mounting surface 54 and a second strip 58 of such material is secured to the same side wall of the ping pong table supporting ball capture member 16. Thus, coupler member 48 is utilized to support the ball outlet end of tubular member 10 and ball receiving member 40. As perhaps best shown in FIG. 2 a flange 34 projects into the interior of conduit portion 50 for engagement by ball receiving member 40. A recess 36 in the flange receives a detent 38 on member 40 for properly positioning member 40 relative to conduit portion 50. Preferably, another recess is formed in the flange diametrically opposed to illustrated recess 36 to allow for repositioning of the member 40 relative to the conduit portion 50 to accommodate different mounting conditions, e.g. mounting of the device on an opposite table wall.

Figure 3:
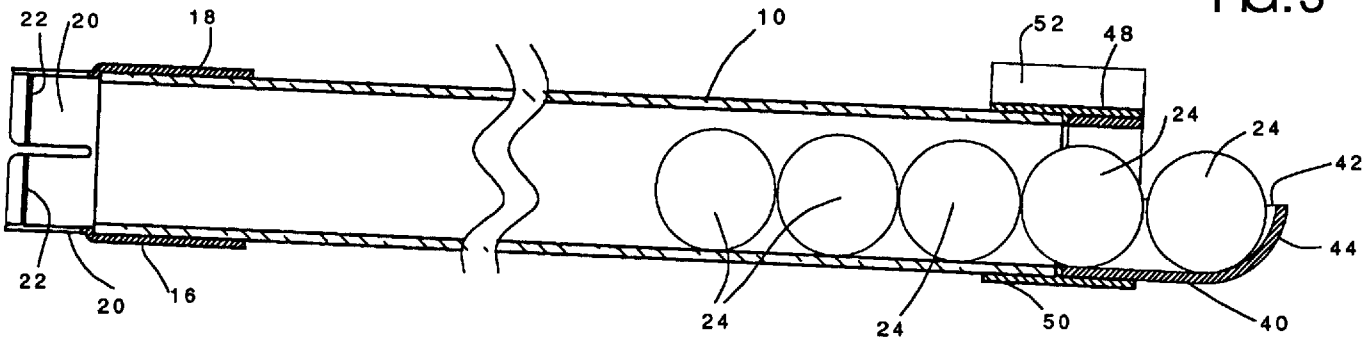
FIG. 3 is a cross-sectional side view of the apparatus illustrating ping pong balls in the interior of the tubular member thereof and one ball positioned for retrieval by a player.
Figure 6:
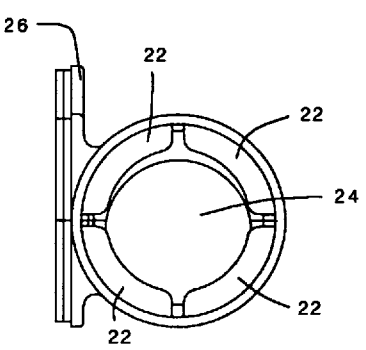
FIG. 6 is an end view of the apparatus as viewed from the left in FIG. 3.
Figure 5:
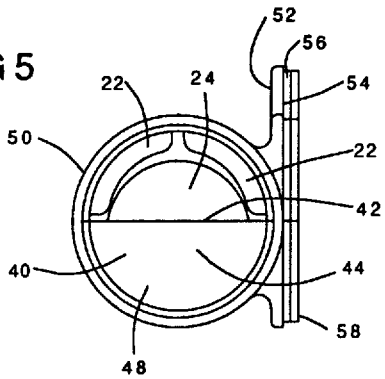
FIG. 5 is an end view of the apparatus as viewed from the right in FIG. 3.

FIG. 1 shows the ball capture member 16 and coupler member 48 releasably connected to a side wall of the ping pong table 30. As is illustrated in FIG. 3, these members are relatively positioned to one another and to the ping pong table so that the ball inlet 12 of the tubular member is elevated relative to the ball outlet 14 thereof. This will result in continuous gravity feed of balls 24 within the interior of the tubular member 10 to the ball receiving member 40. Removal of the end-most ping pong ball from ball receiving member 40 by a player will result in the automatic feed of the next end-most ball into position against ball stop 44.

The reversibility feature of the coupler member 48 is important since it will allow mounting of the coupler member and related structure on any of the four side walls of the ping pong table.

It will be appreciated that the arrangement just disclosed permits ready conversion of the apparatus from a dispensing function to a ball pick up function and vice-versa. Both functions are carried out in an expeditious manner with structure that is both simple in operation and low cost.

I claim:

1. Apparatus for use in association with a ping pong table having table side walls and for alternatively retrieving and serially dispensing ping pong balls, said apparatus comprising, in combination:

a double-ended, elongated tubular member defining a tubular member interior, a ball inlet at one end of the double-ended, elongated tubular member and a ball outlet at the other end of the double-ended, elongated tubular member, said ball inlet and said ball outlet communicating with said tubular member interior;

ball capture means connected to said double-ended, elongated tubular member at said ball inlet for allowing the serial ingress of balls through the ball inlet into the tubular member interior and for resisting egress of balls from the tubular member interior through said ball inlet;

ball receiving means connected to said double-ended, elongated tubular member at said ball outlet for serially receiving balls from said tubular member interior, said ball receiving means for accommodating an end-most ball of a plurality of balls in said tubular member interior defining an opening allowing manual access to and retrieval of the end-most ball, and including a ball stop for retaining the end-most ball in registry with said opening;

releasable mounting means for releasably mounting said double-ended, elongated tubular member, said ball capture means and said ball receiving means on a table side wall with the ball inlet of said double-ended, elongated tubular member elevated relative to the ball outlet thereof and said ball capture means elevated relative to said ball receiving means for promoting gravity feed of balls within said tubular member interior to said ball receiving means, and said releasable mounting means allowing ready removal of said double-ended, elongated tubular member, said ball capture means and said ball retrieving means from said table as a unit for collecting balls in said tubular member interior; and a coupler member releasably interconnecting said double-ended, elongated tubular member and said ball receiving means, said coupler member having a mounting surface for mounting on the table side wall to support said double-ended, elongated tubular member and said ball receiving means, said coupler member being in frictional engagement with said double-ended, elongated tubular member and with said ball receiving means, and said coupler member being reversible relative to said ball receiving means and relative to said double-ended, elongated tubular member to chance the location of the mounting surface of the coupler member relative to said ball receiving means and relative to said double-ended, elongated tubular member.

2. The apparatus according to claim 1 wherein said coupler member includes an open-ended conduit and a projecting element projecting laterally from said open-ended conduit and forming said mounting surface.

3. The apparatus according to claim 1 wherein said ball capture means includes an open-ended conduit having flexible, spaced conduit wall elements, said flexible spaced conduit wall elements having distal ends, and said ball capture means additionally comprising projections attached to said flexible spaced conduit wall elements, and said projections projecting inwardly from said spaced conduit wall elements to define a restricted opening and engageable by balls entering said tubular member interior.

4. The apparatus according to claim 3 wherein said ball capture means is of integral, molded plastic construction.

* * * * *